US005337632A

United States Patent [19]

Thomas et al.

[11] Patent Number: 5,337,632

[45] Date of Patent: Aug. 16, 1994

[54] COMBINATION BEVERAGE CONTAINER AND DOOR OPENER

[75] Inventors: Donald L. Thomas, St. Clair Shores, Mich.; Jane Ryan, New Lebanon, N.Y.

[73] Assignee: Nailco, Inc., Livonia, Mich.

[21] Appl. No.: 83,917

[22] Filed: Jun. 28, 1993

[51] Int. Cl.[5] ..... B67B 7/40; B25F 1/00; B25B 9/00

[52] U.S. Cl. ..... 81/3.55; 81/3.09; 81/15.9; 7/169; 7/170

[58] Field of Search ..... 81/3.09, 3.55, 3.57, 81/3.4, 15.9, 488; 7/169, 170; 294/25, 26; 254/131

[56] References Cited

U.S. PATENT DOCUMENTS

| | | | |
|---|---|---|---|
| 943,759 | 12/1909 | Vaughn . | |
| 2,576,800 | 11/1951 | Menderman . | |
| 3,132,421 | 5/1964 | Huck, Jr. . | |
| 3,459,075 | 8/1969 | Henderson | 81/3.34 |
| 3,460,411 | 8/1969 | Dyer | 81/3.34 |
| 3,872,745 | 3/1975 | Garza et al. | 81/3.55 |
| 4,373,246 | 2/1983 | VanHoutte et al. | 29/426.4 |
| 4,416,171 | 11/1983 | Chmela et al. | 81/3.46 |
| 4,466,313 | 8/1984 | Gardner | 81/3.46 |
| 4,524,646 | 6/1985 | Kimberlin, Jr. | 81/3.55 |
| 4,530,260 | 7/1985 | Holka | 81/3.55 |
| 4,617,842 | 10/1986 | Yang | 81/3.69 |
| 4,774,859 | 10/1988 | Jarvis, Sr. | 81/3.27 |
| 4,788,893 | 12/1988 | Sutton | 81/15.9 |

*Primary Examiner*—Roscoe V. Parker
*Attorney, Agent, or Firm*—Dykema Gossett

[57] ABSTRACT

An opener, especially for opening tab-top beverage containers and certain vehicle door handle systems has an essentially flat, rectangular handle portion with a curved tail end and a hook disposed at an opposite end of the handle portion. The inventive opener simplifies the tasks of opening tab-top beverage containers end certain vehicle door handle systems, while protecting a user's hands and fingernails.

9 Claims, 1 Drawing Sheet

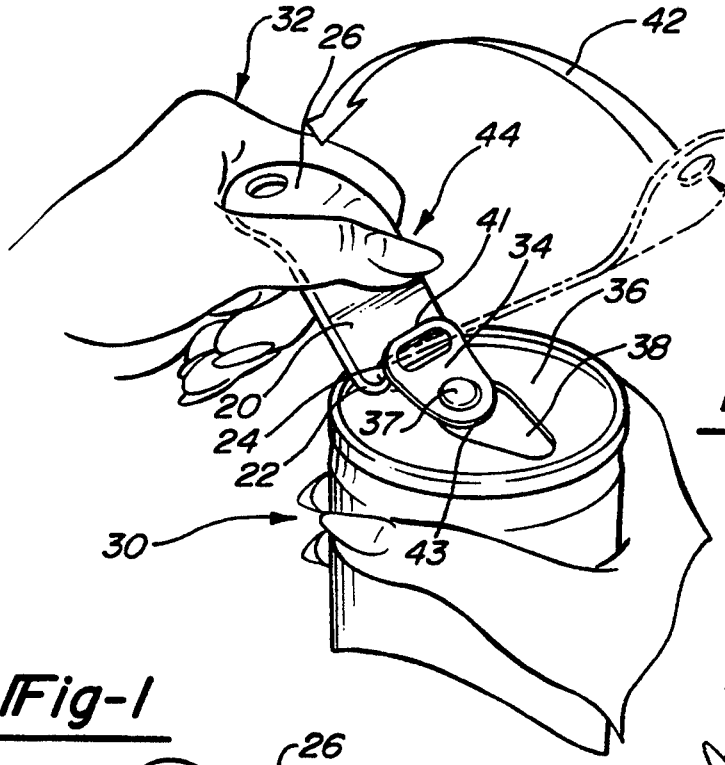
Fig-3
Fig-1
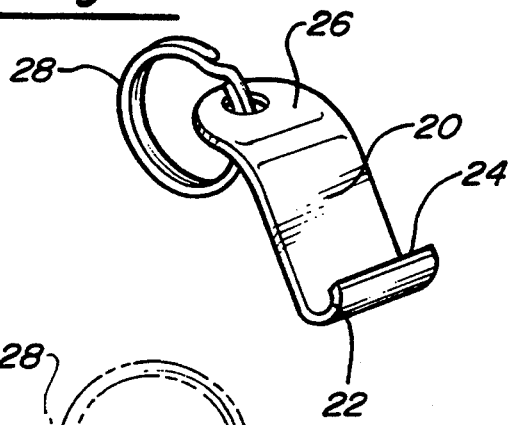
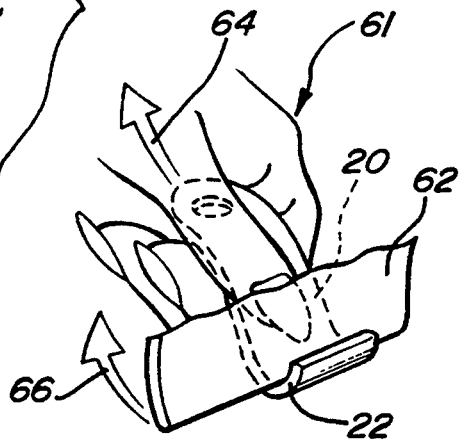
Fig-5
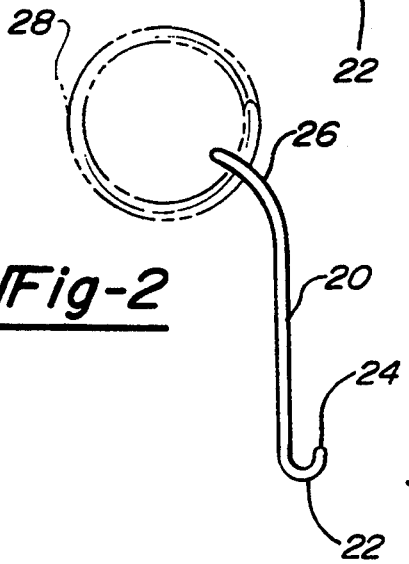
Fig-2
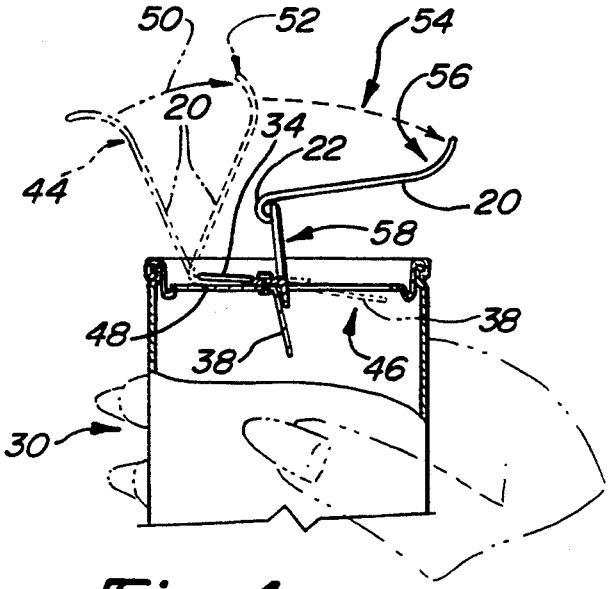
Fig-4

COMBINATION BEVERAGE CONTAINER AND DOOR OPENER

The present invention relates to an opener suitable for opening a tab-top beverage container as is commonly used in the beverage bottling and distribution industry. The present invention is also suitable for assisting in opening certain car door handle systems.

BACKGROUND OF THE INVENTION

People often have difficulty opening conventional tab-top easy-open beverage containers. Typically the index finger is used to pry and pull the tab on the beverage container in order to open it. This task often causes damage to the finger and nails. This is especially true for long fingernails. Also the finger may sometimes be cut. Further, opening such containers is difficult for young children, the elderly and those with an arthritic condition. Certain car door handle systems are difficult to open for people with long fingernails, who may damage or break their nails on the car door handle.

Various types of aids are known for opening tab-top containers. In general, these aids have a wedged surface that is forced under the tab. This movement itself may damage the user's fingers or nails. Further, these wedge type aids do not complete the opening of the tab. A user typically must manually force the tab further.

SUMMARY OF THE INVENTION

The present invention discloses an opener suitable for use with beverage cans characterized by a score-lined closure on an end wall. Such cans have a tab attached to the end wall that is manipulatable in such a way as to open the closure. The tab usually has a beveled edge at one end, while an opposite end lies proximate the closure to interact therewith. The tab is pivotable to bring the beveled edge, which initially lies substantially close to the end wall, away from the end wall. The score-lined closure opens responsively to the tab being pivoted.

The inventive opener is also suitable for use with automobile door opening systems characterized by an integrally hinged, plate-like door handle. Such door handle systems are configured so that when the handle is pulled upwardly and outwardly relative to the door surface, the door latching mechanism is disengaged responsively.

In particular, the inventive opener includes a handle portion with a curved tail end at one end and a hook at the other end. The combination of the curved tail end, the hook, and the handle portion work in combination to protect a user's fingers and nails and also to assist the user in fully opening the container or vehicle door. The present invention is useful to assist those having difficulty opening the above described beverage containers or automobile door opening systems. Further, the inventive opener facilitates such opening procedures while concurrently providing protection to the user's hands and fingernails.

A user opens a tab-top beverage container by simply holding the opener within the palm of one hand, particularly between an index finger and thumb, grasping the beverage container in their opposite hand, positioning the opener hook edge underneath the beveled edge of the tab on the beverage container, such that the handle is positioned generally above and parallel to the container end wall. After inserting the edge of the hook under the tab, a simple arcuate motion of the opener in a direction away from the end wall of the container causes the beveled edge of the tab to be raised slightly off the container end wall. The opposite tab edge is concurrently moved inward toward the container slightly piercing the beverage container score-lined opening. Then, by moving the handle back towards and beyond the above described initial position, it is possible to pull the beveled edge of the tab generally toward the opening, thereby forcing the closure deeper into the recess of the container, fully opening the beverage container. It can be seen that, in this manner, the present invention greatly simplifies the opening of a tab-top beverage container.

A user can also simply open the above described type of automobile door handle system by using the inventive opener. The user simply takes hold of the inventive opener handle, again between the thumb and index finger, inserts the inventive hook underneath the door handle and pulls in an upward and outward direction relative to the door surface, as if to pull on the handle without the assistance of any device. The user thus avoids direct contact with the door handle, thereby avoiding possible damage to fingernails. Further, the invention provides a means of giving additional leverage to open a door handle where such leverage is not otherwise achievable. For example, a person who has fingernails that are too long to allow their fingers to fit behind the door handle sufficiently to be able to pull upon the handle, may not be able to apply enough leverage to disengage the door latching mechanism.

These and other objects of the present invention will be apparent to those skilled in the art from the following specification and claims, making reference to the appended drawings of which the following is a brief description.

BRIEF DESCRIPTION OF THE DRAWINGS

FIG. 1 is a perspective view of the present invention.

FIG. 2 is a side planar view of the present invention.

FIG. 3 is a perspective view of the present invention employed during the initial stages of opening a beverage container.

FIG. 4 is, a perspective view of the present invention employed during the final stages of opening a beverage container.

FIG. 5 is a perspective view of the present invention employed to open a vehicle door handle system.

DETAILED DESCRIPTION OF THE INVENTION

Referring first to FIG. 1, a first embodiment of the present invention is shown in perspective view. The inventive opener includes a generally flat rectangular handle portion 20 adjacent to a hook 22 having an edge 24. At the end of the handle portion 20 opposite the hook 22 there is a curved tail end 26. The tail end is curved in such a way as to provide leverage behind a human finger when a thumb is placed upon the rectangular face 20 (see FIGS. 3 and 5) to execute an opening procedure. The tail end 26 is curved away from face 20 in a direction opposite to the direction the hook 22 is curved away from the face 20. FIG. 1 also shows a key ring 28 connected to the tail end 26.

Referring now to FIG. 2, the inventive opener is shown from a side view. The handle portion 20, the curvature of tail end 26 and the curvature and relative length of the hook 22 are shown to scale. FIG. 2 illustrates how the tail end 26 is gradually curved away from handle portion 20 at less than 90 degrees while hook 22 is curved away from handle portion 20 at approximately 180 degrees. Therefore, hook 22 effectively turns 180 degrees such that edge 24 is directly opposed to the rectangular face of handle portion 20. In one preferred embodiment, the inventive opener is formed of injection molded plastic. The ring 28 can be of any suitable material adaptable to holding keys as a key ring commonly known in the industry which, therefore, will not be further described. In one preferred embodiment of the invention, the overall size of the inventive opener is small allowing it to be used effectively yet conveniently carried in a pocket or purse as a typical key chain.

In FIG. 3, a beverage container is held within one hand of a user at 30. There is also shown, the user's other hand holding the inventive opener generally at 32. The beverage container has a tab 34 which is connected to the end wall 36 via rivet 37 such that it is pivotably movable to force closure 38 to move inward into the beverage container thereby opening the container. Such beverage containers are well known in the art and will not be described further herein.

FIG. 3 illustrates the initial stages of opening the beverage container. The position of the inventive opener illustrated in phantom generally at 40 is the initial position an opener is positioned at to initiate an opening operation. Preferably, the user positions their thumb downward, beneath the handle portion 20, toward the end wall of the beverage container. At position 40, hook edge 24 is inserted underneath the beveled edge 41 of tab 34 such that hook 22 effectively grasps the tab 34. Then, by simply manipulating the inventive opener along the path indicated by the arrow 42, while maintaining hook 22 beneath tab beveled edge 41, it is possible to lift the beveled edge 41 of the tab 34 enough to force the tab opposite edge 43 downward, thereby forcing closure 38 into the container beyond end wall 36. The final position of the user's hand and the inventive opener after this motion is illustrated generally at 44.

Referring now to FIG. 4, the reminder of the beverage container opening operation is shown. The inventive opener is shown in phantom at position 44 which is the same position 44 shown in FIG. 3. In this position, there now exists a gap 48 between the tab 34 and end wall 36. The inventive opener 20 is then moved along the path indicated by arrow 50, approximately to the position illustrated in phantom generally at 52 to complete the opening procedure. From position 52, the user simply pulls upon the handle portion 20, and tail end 26 of the inventive opener along the path indicated by arrow 54 maintaining hook 22 beneath tab 34 eventually stopping with the opener in the position illustrated generally at 56. Because of the position of tab edge 43 relative to closure 38, closure 38 is moved downward, deeper into the beverage container, thereby fully opening the container with this movement. At this point, tab 34 is in position 58 basically vertical and normal to end wall 36 of the container. Further, beverage container closure 38 has been moved to a position illustrated generally at 60 making it possible to dispense the contents of the beverage container. In this manner, the inventive opener simplifies the opening operation of a tab-top beverage container while avoiding the common risk of possibly injuring a finger or damaging a fingernail.

Referring now to FIG. 5, a basic automobile door opening operation employing the inventive opener is shown in perspective view. A hand is shown holding the inventive opener generally at 61 positioning hook 22 underneath the door handle 62. Simply moving the hand, and consequently, the opener in the direction indicated by arrow 64 will correspondingly move the hinged door handle 62 in the direction generally indicated by arrow 66. In this manner, the door handle is lifted arcuately normal to the door surface and normal to the ground such that the door latching mechanism is disengaged responsively. Therefore, the inventive opener allows one with long fingernails to pull open such a car door handle without damaging their fingernails. Further, the inventive opener provides the advantage of allowing quick and easy door opening for those having nails so long that they are unable to insert their fingers sufficiently far enough under the handle to achieve the leverage needed to open the door.

It will be apparent to those skilled in the art that the foregoing disclosure is exemplary rather than limiting in nature, the invention being limited only by the appended claims.

What is claimed is:

1. An opener comprising:

a handle portion for grasping said opener, and having an essentially flat rectangular face with a length, width and thickness, said flat rectangular face being longer than it is wide and wider than it is thick, and a curved tail end of a sufficient length and curvature to enable a user of said opener to open an item with a single continuous arcuate motion of said opener, said curved tail end extending from one end of said handle; and a hook extending from a second end of said handle, an edge of said hook being defined at the end of said hook, remote from said handle, whereby said hook edge may be positioned under an item to be opened and said opener may be pulled in said single continuous arcuate motion generally away from the item.

2. An opener as recited in claim 1 wherein said hook curvature protrudes away from said handle in a direction opposite to the curvature of said curved tail end.

3. An opener as recited in claim 2, wherein said curved tail end defines an included angle of less 90 degrees with said handle and said hook defines an included angle of approximately 180 degrees with said handle.

4. An opener as recited in claim 1 having a uniform thickness and uniform width through said handle and said hook.

5. An opener as recited in claim 1 wherein said handle tail end contains a key ring.

6. A combination door and container opener suitable for opening a vehicle door that has a door handle system that includes an essentially flat semi-rectangular door handle integrally hinged in a manner allowing it to be lifted in a direction normal to the door surface and normal to the ground surface along an essentially arcuate path, the door latching mechanism being disengagable responsively to the door handle being lifted, and for opening a tab-top container that has an end wall with a tab attached thereto, the tab having a beveled edge disposed at one end lying substantially close to the end wall of the can, and the end wall having a closure located proximate an opposite end of the tab, the tab being pivotable to bring the beveled edge away from the end wall and a closure being openable responsively to the tab being pivoted, the opener comprising:

a handle portion for grasping said opener and having an essentially flat rectangular face with a length, width, and thickness, said handle being longer than it is wide and wider than it is thick, and a curved tail end that is long enough and sufficiently curved to provide at least the minimum pulling and prying leverage needed to open the vehicle door and the tab-top container in a single continuous arcuate motion extending from one end of said handle; and a hook extending from a said second end of said handle portion an edge of said hook being defined at the end of said hook remote from said handle whereby when said hook edge is positioned under a door handle and said opener is pulled in an upwardly arcuate motion generally away from the door surface, the door handle is generally rotated away from the door surface causing the door latching mechanism to disengage responsively, or when said hook edge is positioned under the tab beveled edge and said handle portion of said opener is moved in said single continuous arcuate motion generally away from the container end wall, the tab beveled edge is displace away from the container end wall causing an opposite tab edge to press down upon the closure thereby causing the closure to open responsively.

7. An opener as recited in claim 6 wherein said hook curvature protrudes away from said handle in a direction opposite to the curvature of said curved tail end.

8. An opener as recited in claim 7, wherein said curved tail end defines an included angle of less than 90 degrees with said handle and said hook defines an included angle of approximately 180 degrees with said handle.

9. An opener as recited in claim 6 having a uniform thickness said thickness being small enough to allow maid hook edge to be received under said tab beveled edge when maid container is closed.

* * * * *

UNITED STATES PATENT AND TRADEMARK OFFICE

CERTIFICATE OF CORRECTION

PATENT NO. : 5,337,632
DATED : August 16, 1994
INVENTOR(S) : Thomas et al.

It is certified that error appears in the above-indentified patent and that said Letters Patent is hereby corrected as shown below:

Col. 6, line 4, the word "displace" should be --displaced--

Col. 6, line 19, the word "maid" should be --said--

Col. 6, line 20, the word "maid" should be --said--

Signed and Sealed this

Twenty-fifth Day of October, 1994

*Attest:*

*Attesting Officer*

Bruce Lehman

BRUCE LEHMAN

*Commissioner of Patents and Trademarks*